United States Patent [19]

Wilson

[11] 4,265,838

[45] May 5, 1981

[54] CARBURETOR FAST IDLE CAM MECHANISM

[75] Inventor: Donald H. Wilson, Auburndale, Mich.

[73] Assignee: Ford Motor Company, Dearborn, Mich.

[21] Appl. No.: 138,966

[22] Filed: Apr. 10, 1980

[51] Int. Cl.[3] ..... F02M 3/06

[52] U.S. Cl. ..... 261/52

[58] Field of Search ..... 261/52

[56] References Cited

U.S. PATENT DOCUMENTS

| | | | |
|---|---|---|---|
| 2,189,219 | 2/1940 | Olson . | |
| 3,542,346 | 11/1970 | Keenon . | |
| 3,920,777 | 11/1975 | Harrison et al. | 261/52 |
| 3,962,379 | 6/1976 | Freismuth et al. . | |
| 4,196,156 | 4/1980 | Rogerson et al. . | |

*Primary Examiner*—Tim R. Miles

*Attorney, Agent, or Firm*—Robert E. McCollum; Clifford L. Sadler

[57] ABSTRACT

An automotive type carburetor has a fast idle cam mechanism that provides a dual path of operation that includes one ramp for engagement with the throttle valve stop screw for progressively closing the throttle valve as a function of temperature increases towards the normal operating level, and a second ramp engagable by the stop screw for automatically indexing the stop screw for an automatic return of the fast idle cam to a high cam step position upon a restart of a cold engine without necessitating any action on the part of the vehicle driver other than to render operable the vehicle ignition system.

12 Claims, 5 Drawing Figures

CARBURETOR FAST IDLE CAM MECHANISM

This invention relates in general to an automotive type carburetor. More particularly, it relates to the fast idle cam mechanism for such a carburetor that provides an automatic indexing of the fast idle cam for movement to a high cam step position for a cold engine start.

Most commercial vehicle type carburetors equipped with cold enrichment systems include a fast idle cam. The cam is usually moved by a thermostatically responsive coiled spring to project more and more into the path of closing movement of the throttle valve stop screw as the temperature becomes colder. This will provide progressively richer than normal air/fuel mixtures for cold engine operation. The cam usually has a high cam step for the coldest engine starting, followed sequentially, by a number of lesser projecting steps.

The fast idle cam per se usually has a weighted portion so that it will fall by gravity in a direction permitting closing of the throttle valve to its normal engine curb idle speed position. The throttle valve has a stop screw fixed to it and frictionally engageable with the edge face of the fast idle cam to resist rotation of the cam until the stop is backed off when the throttle valve is opened. The cam then can fall by gravity to whichever position is dictated by the coiled spring. The latter has a one way connection to the fast idle cam urging it in a throttle valve opening direction as the temperature decreases below a predetermined level to provide a faster idling position of the throttle valve for a cold engine start.

To restart a cold engine, the throttle valve stop must be released or backed off from the fast idle cam to allow the cam to again rotate by gravity to its cold engine start position locating the throttle stop against the high cam step. This invention relates to an indexing mechanism that eliminates the need for the vehicle operator to release the fast idle cam for resetting to the high cam step prior to starting of the engine. This invention automatically repositions the fast idle cam by power means that is rendered operable when the vehicle ignition key is turned to an engine start position. More particularly, this invention relates to the construction of a fast idle cam with a dual path for engagement by the throttle valve stop screw or abutment, one path including the usual series of steps providing the conventional cold engine operation for progressively closing the throttle valve as the engine warms, the other path enabling an automatic return of the fast idle cam to the high cam step for a restart of a cold engine.

It is an object of the invention, therefore, to provide a carburetor fast idle cam of a construction that permits normal operation of the fast idle cam to progressively reduce the throttle valve opening during cold engine operation as the temperature increases above a predetermined point, and additionally permits an automatic resetting or indexing of the fast idle cam to the high cam step position for the restart of a cold engine without necessitating a positive action by the vehicle operator other than a turning of the ignition key in the ignition switch.

It is another object of the invention to provide a fast idle cam construction of the type described that includes a recess in the edge face of the cam, the recess defining a cam follower slot engageable with the throttle valve stop screw or abutment, the slot containing a pair of radially projecting ramp surfaces adapted to be alternately engaged by the throttle stop for first providing a conventional movement of the throttle stop in a throttle valve closing direction during cold engine operation, and subsequently a resetting of the fast idle cam by realigning the throttle valve stop with the other ramp surface that permits the fast idle cam to be returned to its high cam step position.

It is a still further object of the invention to provide a carburetor fast idle cam construction of the type described in which the first ramp surface contains a series of circumferentially spaced steps of differing radial extent for progressive engagement by the throttle valve stop screw or abutment to progressively decrease the throttle valve opening as the temperature increases towards the normal engine operating temperature level, the second ramp being continuously variable along its length to permit a smooth return movement of the fast idle cam to the high cam setting position without disengaging the stop screw from the surface, the end portions of the follower slot constituting turn around portions that force the fast idle cam axially to change the alignment of the stop screw from one ramp surface to the other.

Other objects, features and advantages of the invention will become more apparent upon reference to the succeeding detailed description thereof, and to the drawings illustrating the preferred embodiment thereof, wherein.

Figure 1:
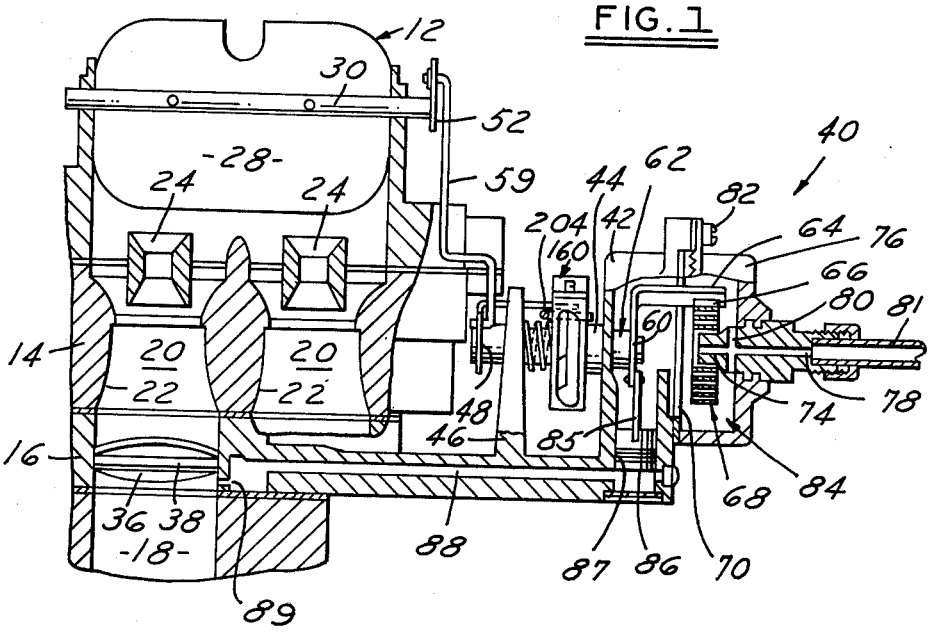
FIG. 1 is a cross-sectional view of a portion of a carburetor embodying the invention.

FIG. 1 is obtained by passing a plane through approximately one-half of a known type of two-barrel, downdraft carburetor. It includes an air horn section 12, a main body portion 14, and a throttle body 16 secured together by suitable means, not shown, over an intake manifold indicated partially at 18 leading to the engine combustion chambers.

Main body portion 14 contains the usual air/fuel mixture induction passages 20 having fresh air intakes at the air horn ends, and connected to manifold 18 at the opposite ends. The passages are each formed with a main venturi section 22 in which is suitably mounted a boost venturi 24.

Air flow into passages 20 is controlled by a choke valve 28 that is unbalance mounted on a shaft 30. The shaft is rotatably mounted in side portions of the carburetor air horn, as shown. Flow of the usual fuel and air mixture through each passage 20 is controlled by a conventional throttle valve 36 fixed on a shaft 38 rotatably mounted in throttle body 16. The throttle valves are rotated in the usual manner by depression of the vehicle accelerator pedal, and move from the idle speed or closed position shown to positions essentially at right angles to that shown.

Figure 5:
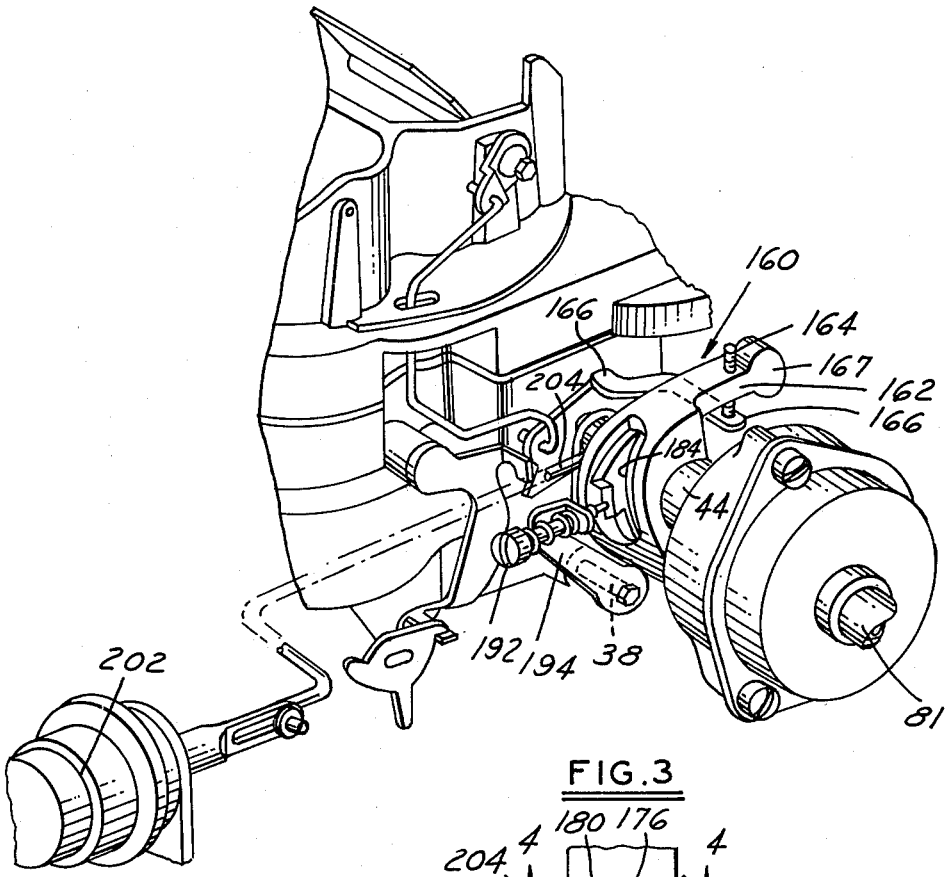

Choke valve 28 rotates from a closed position to the nearly vertical, essentially inoperative position shown. In this latter position, the choke valve provides the minimum obstruction to airflow. The rotative position of choke valve 28 is controlled in part by a semiautomatically operating choke mechanism 40. The latter includes a hollow housing portion 42 that is cast as an integral extension of the carburetor throttle body 16. The housing is apertured for rotatably supporting one end of a choke valve control shaft 44, the other end being rotatably mounted in a support post 46. A bell-crank-type lever 48 fixed on the left end portion of shaft 44 is pivotally connected by a link 59 to a lever 52 fixed on choke valve shaft 30. It will be clear that rotation of shaft 44 in either direction as seen in FIG. 5 will rotate choke valve 28 in a corresponding direction to open or close the carburetor air intake, as the case may be.

The end of shaft 44 in housing 42 has fixed on it one leg 60 of an essentially L-shaped thermostatic spring lever 62. The other lever leg portion 64 is secured to the end 66 of a thermostatically responsive, bimetallic coiled spring element 68 through an arcuate slot, not shown, in an insulating gasket 70. The inner end portion of the coiled spring is fixedly secured on the end of a nipple 74 formed as an integral portion of a choke cap 76 of heat insulating material. Nipple 74 is bored as shown to provide hot air passages 78 and 80 connected to an exhaust manifold heat stove, for example, by a tube 81. Cap 76 is secured to housing 42 by suitable means, such as the screw 82 shown, and defines an air or fluid chamber 84.

As thus far described, it will be clear that the thermostatic spring element 68 will contract or expand as a function of changes in temperature of the air entering tube 81, or, if there is no flow, the ambient temperature of the air within chamber 84. Accordingly, changes in temperature will rotate the spring lever 62 to rotate shaft 44 and lever 48 in one or the other directions, as the case may be.

The leg 60 of lever 64 is pivotally fixed to the rod 85 of a choke pulldown piston 86. The latter is movably mounted in a bore 87 in housing 42. The under surface of piston 86 is acted upon by vacuum in a passage 88 that is connected to one of the carburetor main induction passages 20 by a port 89 located just slightly below throttle valve 36. Piston 86, therefore, is always subject to the vacuum existing in the intake manifold passage portion 18.

The start of a cold engine requires a richer mixture than that of a warmed engine because less fuel is vaporized. Therefore, the choke valve must be shut or nearly shut to restrict air flow and increase the pressure drop across the fuel inlet to draw in more fuel and less air. Once the engine does start, however, then the choke valve should be opened slightly to lean the mixture to prevent engine flooding as a result of an excess of fuel.

The choke mechanism described above automatically accomplishes the action described. That is, on cold weather starts, the temperature of the air in chamber 84 will be low so that the outer end of spring element 68 will move circumferentially. This will rotate lever 48 in a counterclockwise direction to move choke valve 28 to a closed or nearly closed position, as desired. Upon cranking the engine, vacuum in passage 88 will not be sufficient to move piston 86 to open the choke valve. Accordingly, the engine will be started with a rich mixture. As soon as the engine is running, however, the higher vacuum level in passage 88 now moves piston 86 downwardly to rotate shaft 44, lever 48 and link 59 a slight amount sufficient to slightly open the choke valve to lean the mixture.

Figure 2:
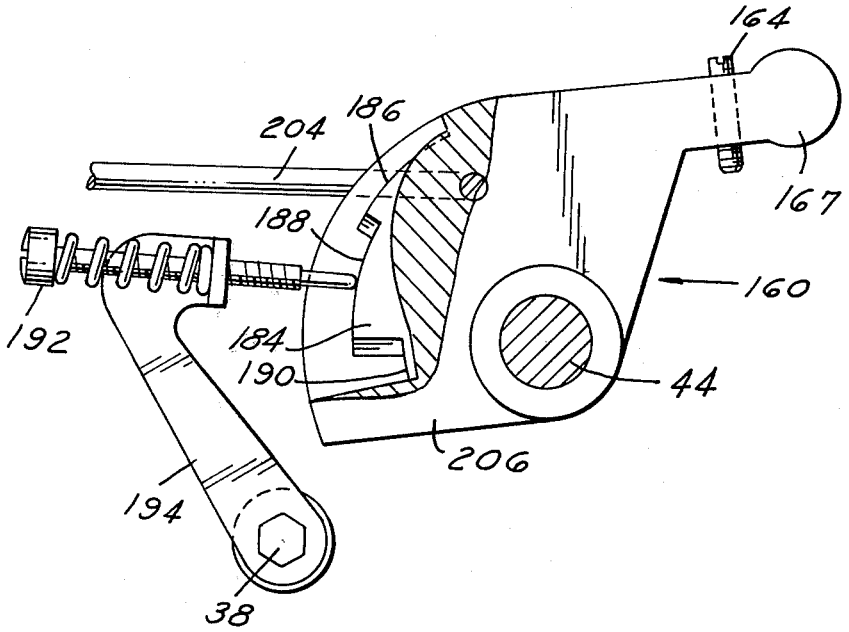
FIGS. 2 and 3 are enlarged cross-sectional views of details of FIG. 1.

During cold engine operation, it is also necessary to open the throttle valve wider to allow enough extra air/fuel mixture into the engine to prevent it from stalling due to the extra friction, greater viscosity of the lubricant, etc. As best seen in FIGS. 1 and 5, rotatably mounted on shaft 44 is a fast idle cam 160. The cam has a projection 162 on one side in which is adjustable mounted a screw 164. The screw has a one-way engagement with a finger or tab 166 that is integral with and projects laterally from the choke lever 48. The fast idle cam projection 162 also contains an enlarged end 167 in which is pressed a weight or ball (not shown) of predetermined mass. The mass and its location is chosen such that the cam will always fall by gravity in a clockwise direction as seen in FIGS. 2 and 5 to follow the movement of tab 166 of lever 48. This will effect rotation of the fast idle cam clockwise progressively as the temperature of bimetal 68 increases.

Figure 3:
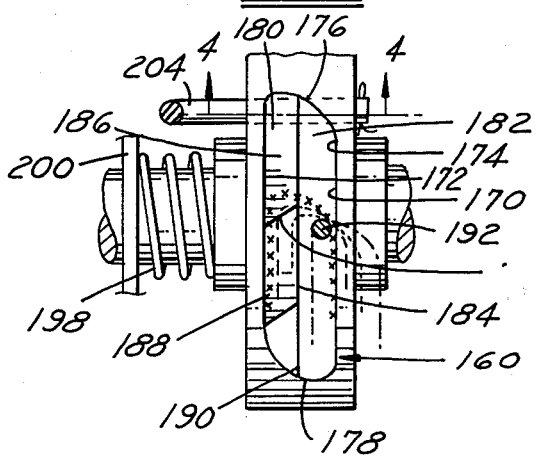
Figure 4:
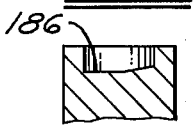
FIG. 4 is a cross-sectional view taken on a plane indicated by and viewed in the direction of the arrows 4—4 of FIG. 3; and, FIG. 5 is a perspective elevational view of the carburetor shown in FIG. 1.

The opposite edge face of cam 160 is formed with a recess 170 that defines a cam follower slot. As best seen in FIG. 3, the slot is formed with a pair of straight side walls 172 and 174 connected at the end portions by turn around arcuate portions 176 and 178. The side walls and end portions together form a rectangularly shaped closed track-like circular path. Within the recess or slot 170 are located two ramps 180 and 182 that extend the length of the slot and vary in radial extent along their lengths from a minimum projection at the turn around end 178 to a maximum projection at the turn around end 176.

The two ramps are arranged in a side-by-side relation contiguous to one another, the ramp 182 being of less radial extent than the ramp 180 to define a lateral abutment type radial shoulder 184 between the two. The two ramps blend together at the turn around end portions 176 and 178, for a purpose to be described.

The left ramp 180 is formed with a series of circumferentially contiguous steps including a high cam step 186, a lower cam step 188, and a third step 190. Each step in counterclockwise circumferential succession is defined by a face that is of less radial extent that the previous one, the lower step 188 being followed by the step 190 of substantially less radial extent. The steps constitute abutments or stops in the path of movement of a throttle valve stop screw 192 that is adjustably mounted on a lever 194 fixed on throttle shaft 38. The radial depth of step 190 is chosen such that when the fast idle cam 160 rotates clockwise by gravity to engage the throttle valve stop screw 192 with the step 190, the throttle valve shaft 38 will have rotated the throttle valve to its normal engine operating temperature level curb idle speed position essentially closing the throttle valve. Engagement of the screw 192 with each of the other steps 188 and 186 progressively locates the idle speed position of the throttle valve at a more open position.

The second or right hand ramp 182, as illustrated in FIG. 2, is shown as varying continuously in radial extent from a location opposite the step 190 to the opposite turnaround end portion 176. When the throttle valve stop screw 192 is frictionally engaged with the second ramp 182, rotation of cam 160 in a counterclockwise direction (FIG. 2) will cause a relative movement between the screw and ramp to in effect move the screw up the ramp towards the turnaround end portion 176.

The fast idle cam 160 not only is rotatably mounted on shaft 44, but also axially mounted for movement between two positions. As best seen in FIG. 3, a spring 198, seated between a retainer 200 and the fast idle cam, normally biases the fast idle cam to the position shown in FIG. 5 aligning the ramp 180 with the stop screw 192.

The cam is axially movable to the left as seen in FIG. 3 to align the stop screw 192 with ramp 182 by the camming action of the stop screw at the turnaround end portion of follower slot 170 as the fast idle cam continues to rotate in a clockwise direction. Thereafter, further clockwise rotation of the cam is prevented because it has reached the end of its travel in this direction. Now, any rotation of the fast idle cam in a counterclockwise direction will provide a relative movement between the stop screw 192 and ramp 182 to in effect cause the stop screw 192 to move up the ramp 182 to return cam 160 to the high cam step position on ramp 180 adjacent the end of the turn around portion 176 of follower slot 170. The radial shoulder 184 between the two ramps acts as a lateral reaction to keep the stop screw on the second ramp surface 182 during the return movement.

As stated previously, and as best seen in FIG. 5, the fast idle cam rotates by gravity in a clockwise direction so that in effect the stop screw 192 moves in a downward direction as seen in FIG. 3 relative to the ram 180.

As best seen in FIGS. 2 and 5, the cam 160 is rotated in a counterclockwise direction by a motor 202. More particularly, an intermediate portion of the fast idle cam 160 is pivotably connected to a link 204 movable by the motor 202. The motor in this case could be an electric motor or a vacuum servo, or other suitable force device, by choice. In the case of a motor, it would be connected to the engine ignition system so that it would be inoperable except during an engine cold starting operation. That is, when the vehicle ignition key is turned to the on or engine start position, current would be supplied to the electric motor (or to a vacuum control valve that would supply vacuum to the servo) when the engine was in a cold starting condition to immediately pull the link 204 leftwardly as seen in FIG. 2 to rotate the fast idle cam counterclockwise. Motor 202 could be disabled by known thermostatic means during hot starting conditions. Therefore, regardless of whether the stop screw 192 is engaged with ramp 180 or 182 of the fast idle cam, the counterclockwise rotation of the fast idle cam will cause the stop screw 192 in effect to move over to ramp 182, if it isn't already on it, and up the ramp to the high cam step position of ramp 180. The steps 186 and 188 of the ramp 180 in this case are provided with beveled edges 206 to force the screw 192 laterally onto the ramp 182, if it should be on ramp 180 at engine start up.

In operation, assume that the engine has been stopped with the choke mechanism at a temperature level below the normal engine operating level; that is, the engine is not fully warmed up. For example, assume that the stop screw 192 is located against the face of step 188 of ramp 180, as seen in FIG. 3. Assume now that at restart, the temperature has decreases to its lowest value. Therefore, the thermostat 68 will now be urging the finger portion 166 of lever 48 up as seen in FIG. 5 (counterclockwise direction) thereby urging the fast idle cam in the same direction. However, since the stop screw 192 is frictionally engaged with step 188 on ramp 180, no relative movement will occur at this time. Upon turning of the ignition key to the engine start position, the motor 202 will be activated to immediately pull the fast idle cam 160 in a counterclockwise direction. Because of the bevel 208 of the steps 186 and 188, the engaged stop screw 192 will cam the fast idle cam 160 leftwardly as seen in FIG. 3 against the bias of spring 198 until the stop screw 192 engages the second ramp surface 182 thereafter. The stop screw in effect then will move up the ramp 182 until it engages the turn around end portion 176 of follower slot 170. At this point, the bias of spring 198 will begin to move the cam 160 axially upon continued counterclockwise rotation of the fast idle cam until the abutment stop screw 192 in effect moves laterally into engagement with the high cam step 186 on the ramp 180. This is indicated by the solid line position of the stop screw 192 in FIG. 3. The fast idle cam and stop screw 192, therefore, are now positioned for a cold engine start. The radial shoulder between the two ramps prevents the abutment from leaving the ramp surface 182 until it reaches the turn around portion 176. These operations are indicated by the various dotted lines in FIG. 3.

Upon engine starting, therefore, engine vacuum is now applied to pulldown piston 86 shown in FIG. 1, which will rotate clockwise the choke valve shaft 44 and lever 48 a predetermined amount, moving finger portion 166 clockwise away from cam 160 to crack open the choke valve by the same degree. This will lean the cranking mixture, preventing stalls. Shortly after this operation, depression of the vehicle accelerator pedal will cause the stop screw 192 to be backed off or rotated out of engagement with ramp 180 and permit the fast idle cam to fall by gravity in a clockwise direction until the screw 164 catches up with and engages the finger member 166. Release of the accelerator pedal then will reposition the stop screw in engagement with the step 188, which is the pulldown position. Less mixture flow and therefore less opening of the throttle valve is needed now that the initial friction, etc., of the engine has been overcome.

As the engine warms and the bimetal 68 continues to turn the lever 48 and finger 166 clockwise, the fast idle cam will follow this movement upon release of the stop screw 192. In effect, therefore, the stop screw 192 moves down the ramp 180 as seen in FIG. 3 towards the follower slot turn around end portion 178. As the engine temperature approaches the normal engine operating level, the cam follower slot 170 is designed for the stop screw to reach the end portion of the slot on ramp 180 for engagement with the step 190. At this point, slight further clockwise rotation of the fast idle cam engages the curved turn around end portion 178 of the cam follower slot with the stop screw and axially moves the cam against the light force of spring 198 to move the stop screw into alignment with the second ramp 182 for resetting or indexing when the engine is again restarted in a cold position.

Assume, therefore, that the engine now is turned off and restarted in its coldest condition. Initially, as stated before, when the ignition key is turned to the on or engine start position, the motor 202 will immediately pull the fast idle cam in a counterclockwise direction as seen in FIG. 2 and, therefore, in effect move stop screw 192 up the ramp 182 to the opposite turn around end portion 176 of the cam follower slot whereupon the fast idle cam is then moved by the light spring 198 rightwardly to align the stop screw with the end of the ramp 180 in the high cam step position. The cycle is then complete.

From the foregoing it will be seen that the invention provides a fast idle cam mechanism that operates in a conventional manner to provide a progressive opening of the choke valve with changes in temperature level, accompanied by an automatic indexing of the fast idle cam for return to the high cam step position associated with the starting of a cold engine.

While the invention has been shown and described in its preferred embodiment, it will be clearer to those skilled in the art to which it pertains that many changes and modifications may be made thereto without departing from the scope of the invention.

I claim:

1. A fast idle cam mechanism for a carburetor having an air/fuel induction passage and a throttle valve rotatably mounted for a pivotal movement across the passage between an essentially closed position to a number of open positions to control the quantity of air/fuel mixture flow through the passage, a stop means fixed for rotation with the throttle valve and adapted to be stopped at times in its pivotal movement in a throttle valve closing direction by frictional abutment against the face edge of a fast idle cam, an axially movable fast idle cam rotatably mounted on a shaft and including a recess in the face edge defining a cam follower slot, the slot having a closed circular track-like shape defined by a pair of side walls and arcuate turn around type end portions, the slot receiving the stop means therein, the slot having a pair of ramps each varying in radial projection along its length and together being in a side-by-side relationship and blending together at their ends at the turn around end portions of the slot forcing relative movement between the slot and stop means upon rotation of the cam, rotation of the cam in one direction moving the one ramp surface relative to the stop means engaged therewith to progressively pivot the stop means to close the throttle valve until the turn around end portion of the slot is engaged by the stop means whereupon continued rotation of the cam in the one direction moves the cam axially for engagement of the stop means with the other ramp surface, subsequent rotation of the cam in the opposite direction thereafter moving the other ramp surface relative to the stop means to progressively pivot the stop means to open the throttle valve until the other turn around end portion of the slot is engaged by the stop means whereupon further rotation of the cam in the other direction effects an axial shifting of the cam to realign the stop means with the one ramp surface for subsequent restarting closing movement of the throttle valve upon subsequent rotation of the cam in the one direction.

2. A mechanism as in claim 1, including spring means biasing the cam axially to align the one ramp surface for engagement by the stop means, the cam being shiftable axially in the opposite direction to align the other ramp surface with the stop means by engagement of the turn around end portion of the slot by the stop means and continued rotation of the cam in a direction camming the cam axially.

3. A mechanism as in claim 2, the one ramp surface having a series of circumferentially spaced steps each of a different radial projection to effect the stopping of the throttle valve stop means in a different idle speed position when engaged with the steps.

4. A mechanism as in claim 3, the other ramp surface having a continuously variable surface for infinitely variable changes in the pivotal movement of the stop means upon engagement with the other ramp surface.

5. A mechanism as in claim 4, the one ramp surface intermediate the end portions projecting further radially than the other ramp surface to define a radial shoulder therebetween for maintaining the stop means aligned with the other ramp surface during rotation of the cam in the opposite direction to prevent axial shifting of the cam by the spring means.

6. A mechanism as in claim 5, the steps having beveled portions urging the cam axially for disengagement of the stop means with the one ramp surface and into engagement with the other ramp surface upon a change in rotation of the cam from the one direction to the opposite direction.

7. A mechanism as in claim 1, including temperature responsive means connected to the cam urging the cam in the one direction of rotation upon increases in temperature above a predetermined level to progressively decrease the open position of the throttle valve.

8. A mechanism as in claim 7, including power means operably connected to the cam and to the engine ignition system and operable upon initial starting of the engine to rotate the cam in the opposite direction to automatically align the other ramp with the stop means and return the stop means to an end turn around portion of the slot for engagement with the one ramp surface.

9. A fast idle cam mechanism for a carburetor having an air/fuel induction passage and a throttle valve rotatably mounted for a pivotal movement across the passage between an essentially closed position to a number of open positions to control the quantity of air/fuel mixture flow through the passage, an abutment fixed for rotation with the throttle valve and adapted to be stopped at times in its pivotal movement in a throttle valve closing direction by frictional abutment against the edge face of a fast idle cam, a fast idle cam rotatably mounted on a shaft an including a recess in the edge face defining a cam follower slot, the slot having a closed circular track-like shape defined by a pair of side walls and arcuate turn around type end portions, the slot receiving the abutment therein, the slot having a pair of radially extending contoured cam surfaces of differing radial projection alternately frictionally engagable by the abutment, one surface being contiguous to one side wall of the slot and the other surface being contiguous to the other side wall of the slot, the surfaces blending at their ends at each turn around end portion of the slot to provide a closed circular path to effect a progressive pivotal rotation of the abutment in a throttle valve closing direction on engagement of the abutment with one surface upon rotation of the cam in one direction towards one turn around end portion of the slot and a return rotation of the abutment in a throttle valve opening direction along the other surface upon a rotation of the cam in the opposite direction towards the slot other turn around end portion, continued rotational movement of an end portion relative to the abutment camming the slot axially to realign the abutment with the other cam surface.

10. A fast idle cam mechanism for a carburetor having an air/fuel induction passage and a throttle valve rotatably mounted for a pivotal movement across the passage between an essentially closed curb idle engine speed position to a number of hot engine open idle speed positions and beyond towards a wide open throttle position to control the quantity of air/fuel mixture flow through the passage, a throttle valve stop rotatable with the throttle valve and adapted to be stopped at times in its movement in a throttle valve closing direction by frictional abutment against the edge face of a fast idle cam, a fast idle cam having an eccentrically disposed edge face, the cam being axially slidable and rotatably mounted on a shaft and weighted to fall by gravity in a first direction towards a position permitting closure of the throttle valve to the curb idle speed position upon disengagement of the stop from the face, thermostatic means having a one-way engagement with the fast idle cam and rotatable in the opposite direction in a throttle valve opening direction in response to temperature decreases below a set level to stop the throttle valve abutment in a hot engine idle speed position, the fast idle cam including a recess in the edge face defining a contoured cam follower slot receiving the throttle valve stop therein, the recess having first and second axially contiguous, outwardly projecting eccentric ramp surfaces adapted to be alternately engaged by the throttle valve stop, the pair merging at opposite ends, the first of the pair projecting radially a different amount than the second of the pair to define a radial shoulder therebetween, the cam being movable axially between first and second positions alternately aligning the first and second ramp surfaces, respectively, with the throttle valve stop, spring means biasing the cam to the first position to locate the stop against the first surface, engagement of the stop with the end of the slot camming the cam axially to the second position upon a predetermined rotation of the cam in the first direction, the first ramp surface having a number of circumferentially spaced steps therein of changing radial extent effecting the stopping of the throttle valve stop in different idle speed open throttle positions when engaged thereagainst upon rotation of the cam in the first direction, and power means operably connected to the cam for rotating the cam in the other direction for a return movement of the stop along the second ramp surface to merge at the end of the slot with the first ramp surface for a subsequent return movement of the cam to the first position.

11. A mechanism as in claim 10, the stop being engagable with the radial shoulder during engagement of the stop with the second ramp surface to permit relative movement between the stop and second surface upon rotation of the cam in the other direction without an axial shifting of the cam until the end of the slot is reached.

12. A mechanism as in claim 11, the power means being connected to the engine ignition system for operation in response to initial startup operation of the engine.

* * * * *